US008360942B2

(12) United States Patent
Goel et al.

(10) Patent No.: US 8,360,942 B2
(45) Date of Patent: Jan. 29, 2013

(54) CORE MUSCLE STRENGTHENING

(75) Inventors: Vijay K. Goel, Holland, OH (US); Kenneth Germano, Delray Beach, FL (US); F. Alan Schultheis, Redding, CT (US); David Dick, Whitehouse, OH (US)

(73) Assignees: The University of Toledo, Toledo, OH (US); The Turning Point LLC, Redding, CT (US)

( * ) Notice: Subject to any disclaimer, the term of this patent is extended or adjusted under 35 U.S.C. 154(b) by 34 days.

(21) Appl. No.: 12/924,989

(22) Filed: Oct. 12, 2010

(65) Prior Publication Data

US 2012/0015777 A1 Jan. 19, 2012

Related U.S. Application Data

(60) Continuation-in-part of application No. 12/661,918, filed on Mar. 25, 2010, now Pat. No. 8,007,421, which is a division of application No. 11/200,358, filed on Aug. 9, 2005, now Pat. No. 7,695,415.

(51) Int. Cl.
*A63B 21/00* (2006.01)

(52) U.S. Cl. ..... 482/140; 482/130

(58) Field of Classification Search ..... 482/142, 482/140, 130
See application file for complete search history.

(56) References Cited

U.S. PATENT DOCUMENTS

| | | | | |
|---|---|---|---|---|
| 3,429,571 | A | 2/1969 | Abel, Jr. | |
| 4,318,546 | A | 3/1982 | Chen | |
| 4,733,860 | A | 3/1988 | Stefee | |
| 4,893,811 | A | 1/1990 | Dilmore | |
| 5,050,885 | A * | 9/1991 | Ballard et al. | 473/216 |
| 5,052,684 | A | 10/1991 | Kosuge et al. | |
| 5,094,249 | A | 3/1992 | Marras et al. | |
| 5,324,247 | A * | 6/1994 | Lepley | 482/134 |
| 5,941,807 | A | 8/1999 | Cassidy et al. | |
| 5,957,816 | A | 9/1999 | Staffa | |
| 6,077,241 | A | 6/2000 | Fareed | |
| 6,537,184 | B2 | 3/2003 | Kim | |
| RE38,057 | E | 4/2003 | Pandozy | |
| 6,551,196 | B1 * | 4/2003 | Kossnar et al. | 473/216 |
| 6,579,214 | B2 | 6/2003 | Crump | |
| 6,726,608 | B1 * | 4/2004 | Hsu | 482/130 |
| 6,786,855 | B2 | 9/2004 | Prichard | |
| 7,695,415 | B2 | 4/2010 | Goel et al. | |
| 2004/0176226 | A1 | 9/2004 | Carlson | |

* cited by examiner

*Primary Examiner* — Jerome W Donnelly
(74) *Attorney, Agent, or Firm* — Emch, Schaffer, Schaub & Porcello Co., LPA

(57) ABSTRACT

The method and system of this invention provides for core muscle strengthening. The method comprises the step of: providing an apparatus (10) that provides resistance and assistance during core muscle training using dynamic therapeutic movement for chest, back, abdominal and leg musculature to strengthen and condition muscles of the axial skeleton and lower extremities of a performing user. In one embodiment, the method also is for non-invasive physical therapy.

5 Claims, 23 Drawing Sheets

SIDE TO SIDE

Both Assisted Stretch & Resistance Exercise
Assistance Provide With Movement
Resistance Provided Opposing Movement Standing Front View

FRONT TO BACK

Assisted Stretch & Resistance Exercise
Assistance Provide With Movement
Resistance Provided Opposing Movement Standing Side View

CORE MUSCLE STRENGTHENING

CROSS REFERENCE

This application is a continuation-in-part of Ser. No. 12/661,918, filed Mar. 25, 2010, now U.S. Pat. No. 8,007,421 which is a divisional application of Ser. No. 11/200,358 filed Aug. 9, 2005, now U.S. Pat. No. 7,695,415 issued Apr. 13, 2010.

FIELD OF THE INVENTION

The present invention relates to a method for core muscle strengthening and improved movement. In another aspect, this invention relates to physical therapy.

The present invention relates generally to devices using dynamic movement of one's body. The invention may be used for chest, back, upper leg, buttock and abdominal musculature and the like. The invention relates more specifically to a device and method for exercising and developing greater flexibility of the spinal column and the muscles of the torso, including those in the abdominal, lumbar and thoracic regions involving rotational movement in a functional posture.

BACKGROUND OF THE INVENTION

In a general embodiment, the invention relates to conditioning, rehabilitation and general fitness exercise application that facilitates Life's Movements of the trunk, upper and lower torso, arms and legs, e.g. every day activities like carrying groceries, lift a baby or reaching for something in the back of a closet. In a preferred embodiment, the invention is an exercise and flexibility apparatus that relates to any sport that requires strength and flexibility in the core, e.g., golf, baseball, hockey, tennis, etc., and particularly to a sport exercise apparatus which provides resistance to an athlete during any sport related movement to strengthen and condition the muscles of the axial skeleton of the athlete.

While this invention is described in terms of exercise and sports performance, the device may be used broadly for general conditioning, and physical therapy and other sports such as swimming, tennis and the like where conditioning and flexibility are desirable. In one embodiment, this invention helps to prevent or minimize minor muscle aches and pains.

Currently, golf, for example, is an activity enjoyed by many people of all ages possessing varying degrees of athletic ability, musculoskeletal strength, flexibility and endurance. Although it is possible to perform a golf swing without having appropriate musculoskeletal support, greater core strength, flexibility and endurance allows a golfer to hit a golf ball farther and with greater accuracy and consistency and to minimize minor muscle related aches and pains.

External devices are currently being marketed to help train the muscles of the golfer to move along a predetermined path which is thought to be along an optimal golf swing path. However, no resistance is supplied in the direction of rotation of the shoulders and upper torso, the hips, and upper legs of the golfer during performance. These devices are not designed to benefit muscular conditioning or flexibility.

Regular exercise may keep the body in good shape, but not all exercise is equally effective. Many exercise devices on the market, particularly in health and athletic clubs, are less effective than patrons may assume, particularly as related to the rotational movements required in many sports and similar day to day activities. Historically, much of the available equipment in health clubs train in predominantly linear, single plane (sagital plane) movement and are limited to isolating one muscle group. The body rarely moves in just one plane and often requires multiple muscle groups to work together. Most body movement involves rotation (transverse plane) and diagonal patterns of movement.

The need exists for a performance, rehabilitation and general conditioning device which permits activity consisting of components of motion in all three planes, and permits isolation of a specific area of the body, the motion of which is most desired. Such a device will permit a physical therapist, chiropractor or trainer to properly prescribe protocols that will help the user achieve their goals related to improving movement.

SUMMARY OF THE INVENTION

"This Core Movement Performance Device for conditioning, rehabilitation and general fitness exercise application facilitates Life's Movements of the trunk, upper and lower torso, arms and legs. In a preferred embodiment, the device is a rotational STRENGTHENING AND RANGE OF MOTION IMPROVEMENT, MEASUREMENT AND TRAINING apparatus for the enhancement of physical movements involving torso rotation. THE APPARATUS WILL optimize utilization of THE APPENDICULAR SKELETON as the muscles of the Axial Skeleton are conditioned."

The three (3) unique strengths captured are as follows: A product to strengthen and improve rotational ROM (range of motion). The ability to of the device to train user to move better—(motor learning, neuromuscular facilitation). The database also includes the acquisition of the information from continued use.

The method and system of this invention provides for core muscle strengthening and improved flexibility. The method comprises the step of: providing an apparatus (10) that provides resistance and assistance during core muscle training using dynamic therapeutic movement for chest, back, abdominal, and leg musculature to strengthen and condition muscles of the axial skeleton and lower extremities of a performing user.

The device of this invention is a performance, rehabilitation and general conditioning machine that provides resistance during an exercise emulating any rotational sport activity or day to day movement to strengthen and condition the muscles of the axial skeleton and lower extremities of the athlete or user. The device includes a support base; a member pivotally mounted to the support base; a torso pivotally mounted axial shaft coupled to the pivotally mounted member; and a pelvis pivotally mounted axial shaft coupled to the pivotally mounted member. A shoulder securement is connected to the torso axial shaft; and a hip harness is connected to the pelvis axial shaft. A torso, independent torque resistor is connected to the torso axial shaft and includes a means for providing resistance in at least two directions.

A pelvis, independent torque resistor also is connected to the pelvis axial shaft, and includes a means to provide resistance in at least two directions. The apparatus includes a means to independently lock the torso shaft in a neutral position and a means to independently lock the pelvis shaft in a neutral position.

The advantage of this new device is that it offers the user professional determined variable resistance in a standing, functional position. The inclination angle from the vertical can be modified to better replicate posture in various sports such as golf, hockey, or baseball or day to day activities. Other devices designed to enhance trunk muscle rotator strength, places the user in a seated position which restricts pelvic motion and distributes a greater proportion of the imposed stress to the vertebrae, thereby increasing the potential for injury. The invention provides resistance to torso and pelvic rotation without restricting the natural rotational movement of the trunk and pelvis. Some of the present devices do not allow the user to undertake strength exercises in a functional posture at all.

The exercise apparatus of this invention provides resistance in a direction of movement. The apparatus comprises means to provide the proper and reproducible biomechanical movement; means to control the resistance; and means to manage the movement. The method that provides resistance in a direction of movement comprises the steps of providing an exercise apparatus; locating a user in the apparatus to provide movement; providing resistance to the movement; controlling the resistance to the movement; and managing the movement.

Other objects and advantages of the present invention will become apparent to those skilled in the art upon a review of the following detailed description of the preferred embodiments and the accompanying drawings.

DESCRIPTION OF THE INVENTION

The method and system of this invention provides for core muscle strengthening and improved flexibility. The method comprises the step of: providing an apparatus (10) that provides resistance and assistance during core muscle training using dynamic therapeutic movement for chest, back, abdominal and leg musculature to strengthen and condition muscles of the axial skeleton and lower extremities of a performing user. In another embodiment, the invention provides a method for physical therapy. The physical therapy provides resistance and assistance during therapy using dynamic therapeutic movements. In another embodiment, the physical therapy is trainer-assisted.

The torso rotation conditioning device of this invention provides the following. The user is in a weight bearing position that simulates a stance in many sports (e.g., golf, baseball or hockey) and many normal day to day activities. The angle of the inclination (posture) is adjustable about a pivot to accommodate individual variation in the standing position.

Human movements are described in three dimensions based on a series of planes and axis. There are three planes of motion that pass through the human body.

The sagital plane.

The frontal plane.

The transverse (horizontal) plane.

The sagital plane lies vertically and divides the body into right and left parts.

The frontal plane also lies vertically however divides the body into anterior and posterior parts.

The transverse plane lies horizontally and divides the body into superior and inferior parts.

An axis is a straight line around which an object rotates. Movement at the joint take place in a plane about an axis. There are three axis of rotation.

Sagital axis.

Frontal axis.

Vertical axis.

The sagital axis passes horizontally from posterior to anterior and is formed by the intersection of the sagital and transverse planes.

The frontal axis passes horizontally from left to right and is formed by the intersection of the frontal and transverse planes.

The vertical axis passes vertically from inferior to superior and is formed by the intersection of the sagital and frontal planes.

There is a tendency when describing a movement for it to be referred to in the particular plane that it dominates. An example of this would be a description of walking as a sagital plane movement.

In reality this is really only a description of the gross direction of movement. At individual joint level, movement will be occurring in several planes not solely in the sagital plane. For example during walking, the hip will be flexing/extending in the sagital plane, adducting/abducting in the frontal plane and internally/externally rotating the in the transverse plane.

The Core Movement Performance of this invention primarily takes place through the transverse and vertical axis. Some movement, however, also takes place in the sagital plane and the frontal axis.

Figure 1:
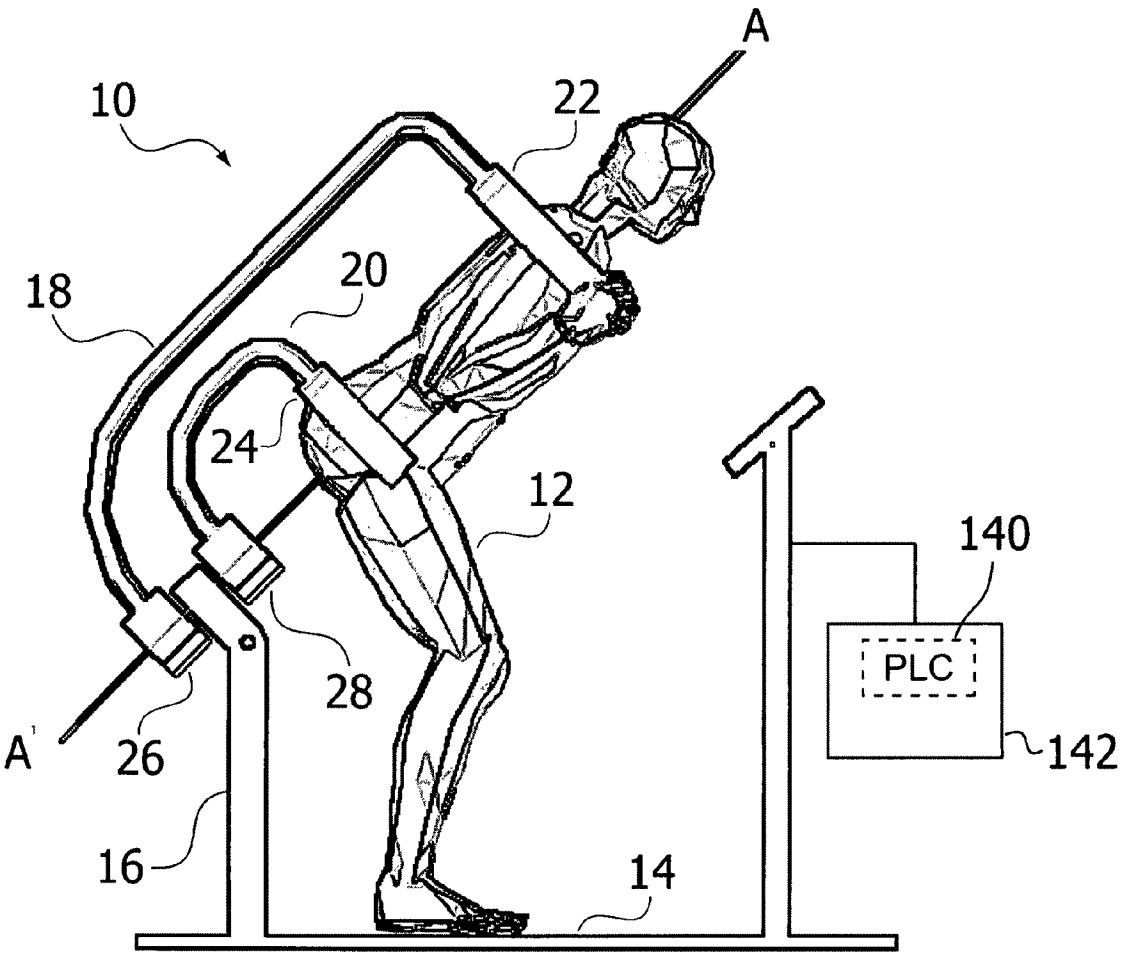
FIG. 1 is a side view illustrating the basic elements of the trunk rotation conditioning device, as well as the position of the user and how it can accommodate to user size.

FIG. 1 is a side view illustrating the basic elements of the trunk rotation conditioning device, as well as the position of the user and how it can accommodate to user size. In the embodiment of a sport exercise apparatus, the device provides resistance during an exercise emulating many required rotational movements in sport, i.e. a baseball swing to strengthen muscles of the axial skeleton and lower extremities of the performing athlete.

FIG. 1 shows exercise apparatus 10 that provides resistance during an exercise using dynamic movement for chest, back, abdominal and leg musculature to strengthen muscles of the axial skeleton and lower extremities of performing user 12. Apparatus 10 comprises support base 14, member 16 pivotally mounted to the support base, variable resistance, torso pivotally mounted axial shaft 18 coupled to pivotally mounted member 16, shoulder harness 22 connected to torso axial shaft 18, hip harness 24 connected to pelvis axial shaft 20, torso independent torque resistor 26 connected to torso axial shaft 18, and pelvis, independent torque resistor 28 connected to pelvis axial shaft 20. The angle of inclination (posture) is adjustable along the sagital axis.

FIG. 1 illustrates the standing neutral position of the user in the device. The user is connected at the shoulder and hip using restraints which are connected rigidly to the arms that rotate about the axis "A" at pivots points. The length of these arms is adjustable to accommodate users of different sizes/heights.

FIG. 1 also shows controller 140 and computer 142 operating exercise apparatus 10 through proprietary circuitry and software, not shown. Controller 140 and computer 142 are wired to their respective drives, sensors and actuators in apparatus 10 through conventional circuitry, not shown.

Figure 2:
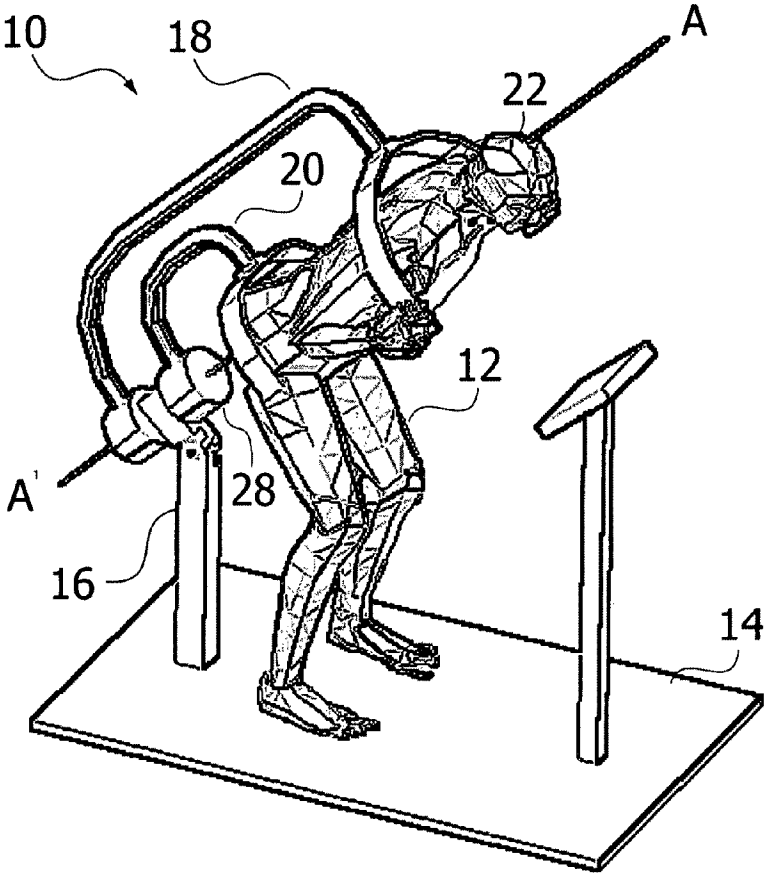
FIG. 2 is a side view in perspective illustrating the hips and shoulders of the user.

FIG. 2 is a side view in perspective illustrating the hips and shoulders of user 12. The hip and shoulder turn are shown in greater detail in FIG. 3. Apparatus 10 includes a support base, a member pivotally mounted to the support base; a torso pivotally mounted axial shaft coupled to the pivotally mounted member; and a pelvis pivotally mounted axial shaft coupled to the pivotally mounted member as described for FIG. 1.

Figure 3:
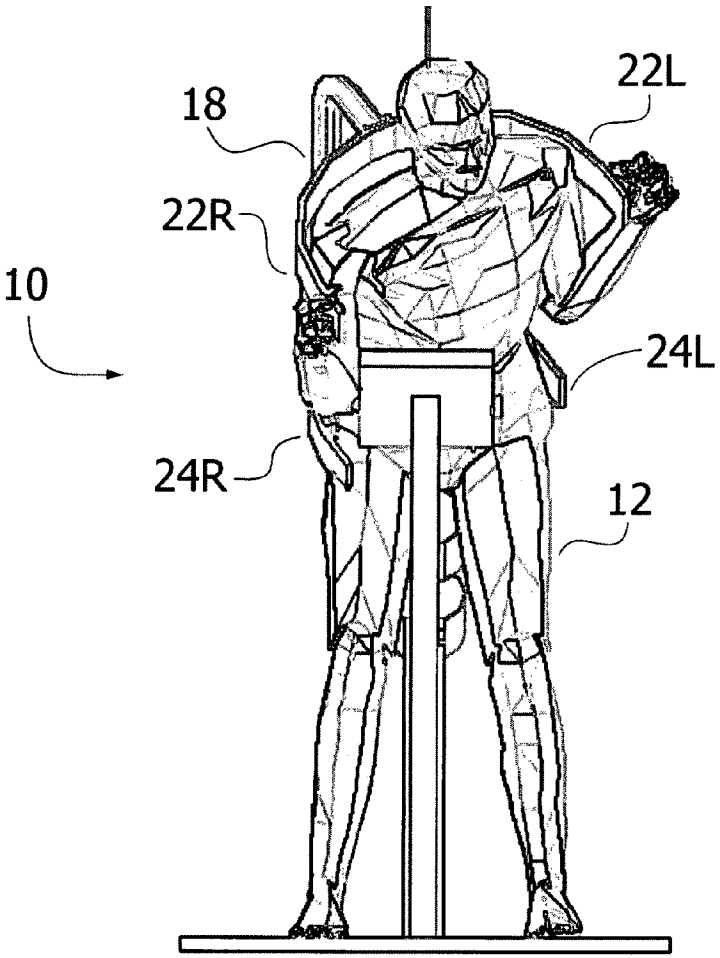
FIG. 3 is a front view of the perspective illustration of FIG. 2 showing the user turned to the left.

FIG. 3 is a front view of the prospective illustration showing a shoulder and hip turn to the left. The user locates himself/herself in this posture within machine 10 such that the axis A-A' of rotation of the exercise motion passes through user's 12 spine, the desired axis of rotation of the hips and shoulders. FIG. 3 shows shoulder harness portion 22 L and hip harness portion 24L turned upwardly and to the left. Also shown in shoulder harness portion 22R and hip harness portion 24R turned downwardly and to the left.

FIGS. 2 and 3 illustrate the torso and pelvis rotation of the user towards the left. A shoulder harness is connected to the torso axial shaft; and a hip harness is connected to the pelvis axial shaft. A torso, independent force resistor is connected to the torso axial shaft and includes a means for providing resistance in at least two directions. The hips and shoulders are provided with variable resistance about the pivots. These resistance can be in the brakes, e.g. dry friction, fluid damping, eddy currents, or magneto-heterodyne, actuators, hydraulic or pneumatic, weight stacks, or expandable rubber bands. Resistance will provide in either direction across the range of possible movement.

FIG. 3 is a front view that illustrates torso and pelvis rotation of the user towards the left. A pelvis, independent force resistor also is connected to the pelvis axial shaft, and includes a means providing resistance in at least two directions. In a preferred embodiment, the apparatus includes a means to independently lock the torso shaft in a neutral position and a means to independently lock the pelvis shaft in a neutral position. Linear potentiometers are provided at the pivots points to measure the angular position of the torso and pelvis. Load cells are located at the pivots to measure the exerted force of the user, independently at the torso and pelvis.

Figure 4:
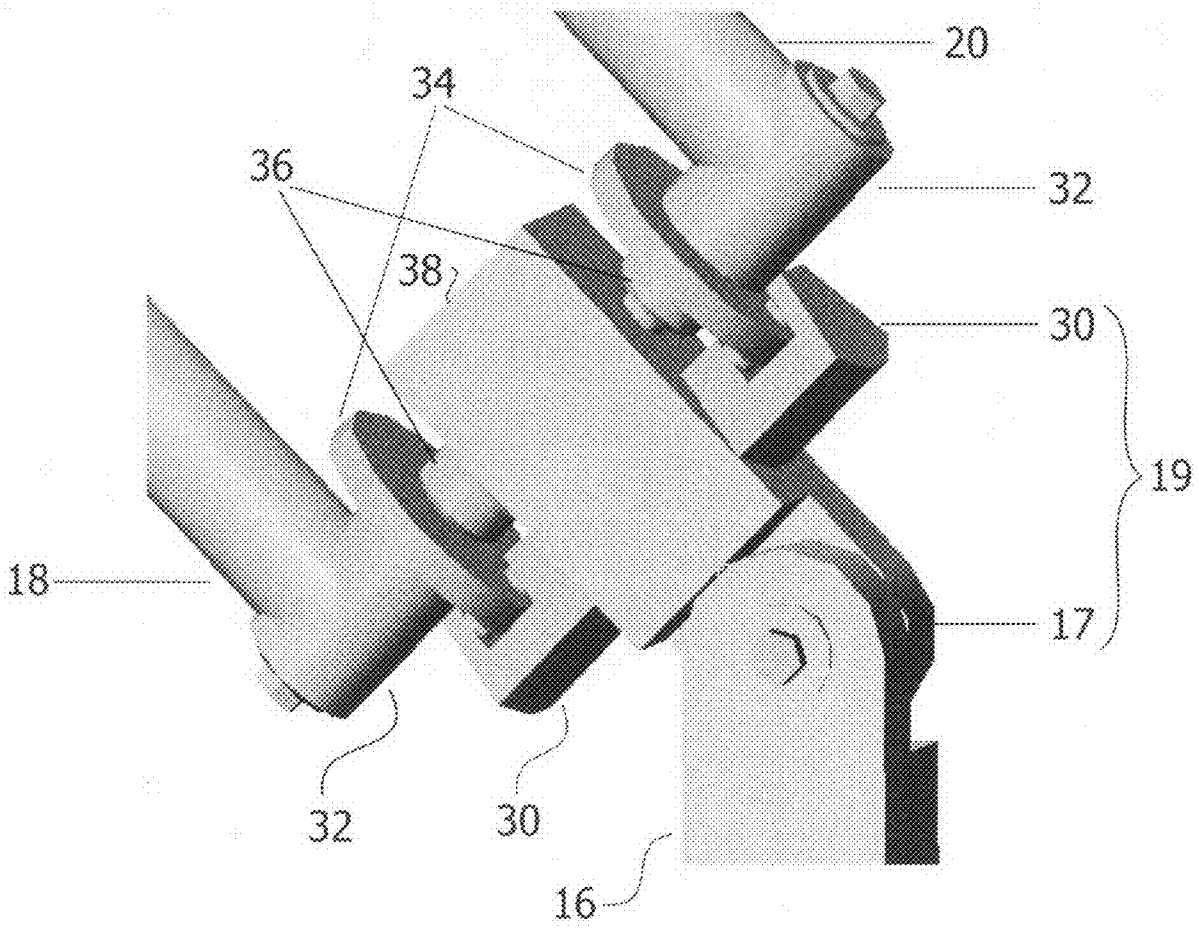
FIG. 4 is a view showing the resistance means that provide the resistance to rotation at the torso and pelvis resistance arm axes of movement.

FIG. 4 is a view showing the hydraulic disk brakes. In another embodiment, magnetic brakes or hydraulic actuators will be shown that provide the resistance to rotation at the torso and pelvis resistance arm axes of movement. The machine has the following additional attributes. The resistance of the shoulders and hips are independently adjustable, and will be user determined and controlled, via a control panel within reach of the user while in the device. The torso and pelvis pivot arms can be independently locked in the neutral position in order to isolate the exercise to the other element.

FIG. 4 shows one embodiment of resistors, 26 and 28, in greater detail. Resistors 26 and 28 each comprise caliper 30, pivot arm 32, rotor 34 and torque and angle measurement device 36. These connect shaft 18 and 20 to member 16 through housing 38. A real-time digital display unit will be provided to the user regarding the position and torque exerted by the torso and pelvis. The maximum difference between the torso and pelvis angle will be calculated and displayed for each exercise cycle.

Figure 5:
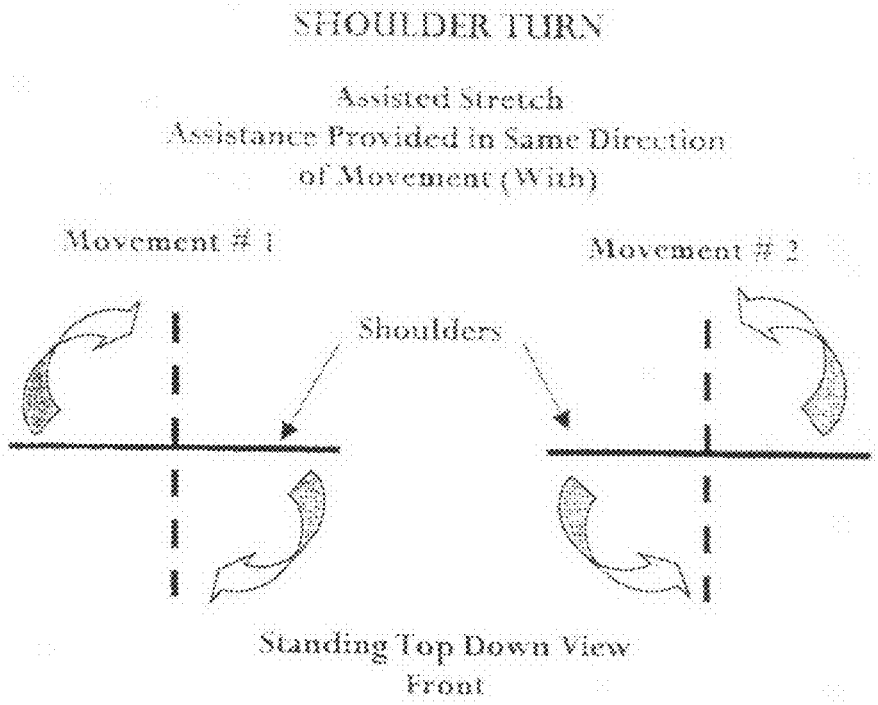
FIG. 5 illustrates shoulder turn according to this invention.
Figure 5:
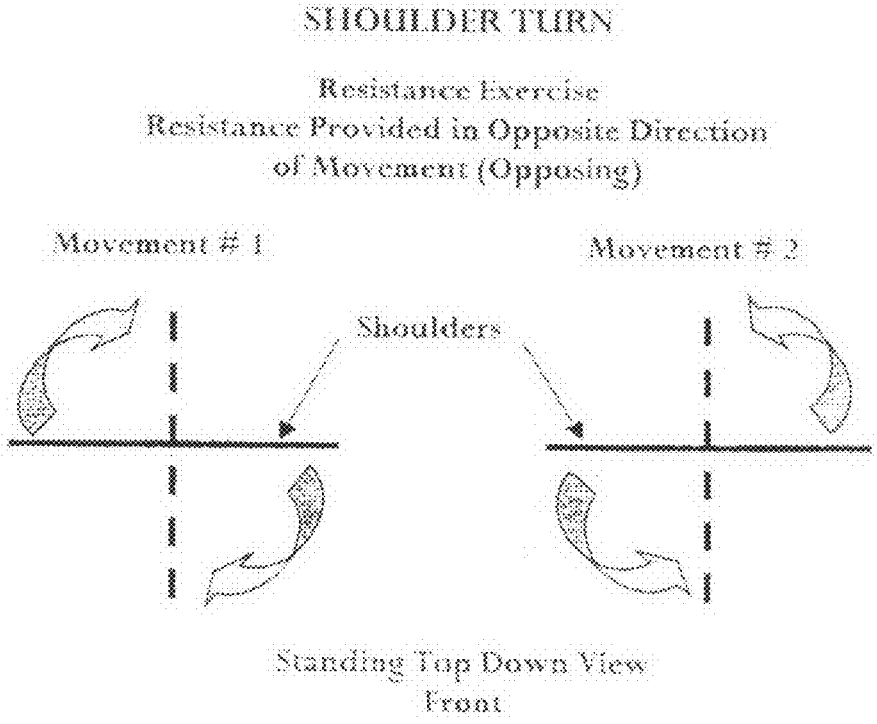

FIG. 5 illustrates shoulder turn according to this invention. The exercise apparatus provides resistance during an exercise using dynamic therapeutic movement for chest, back, abdominal and leg musculature to strengthen muscles of the axial skeleton and lower extremities of a performing user. It includes a means for providing adjustable resistance in two directions and adjustable assisted stretching in two directions.

Figure 6:
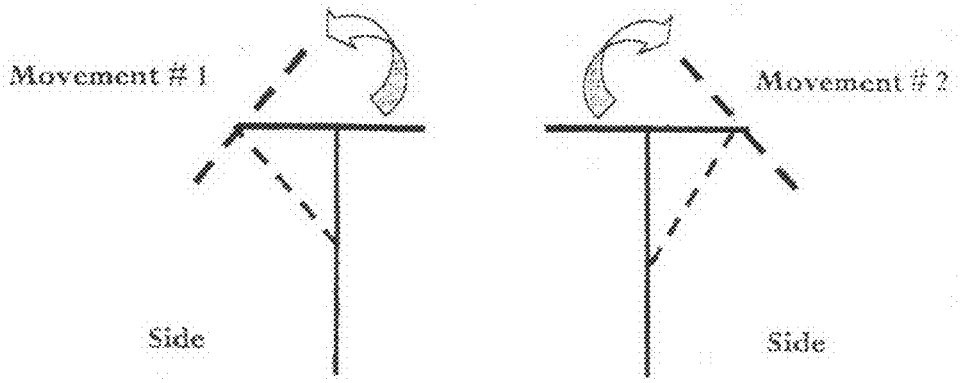
FIG. 6 illustrates side to side and front to back rotation according to this invention.
Figure 6:
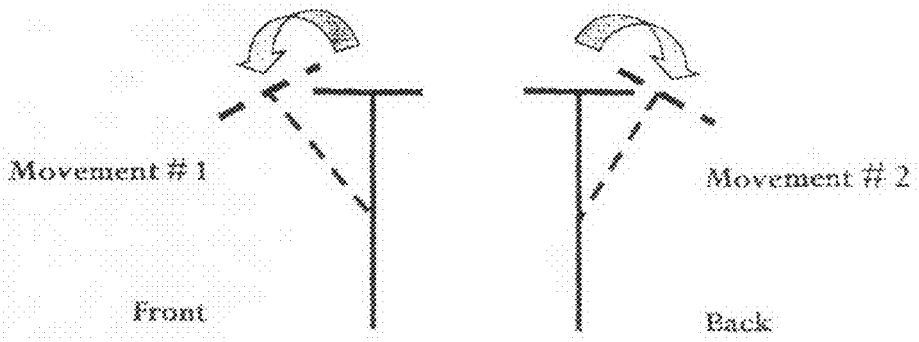

FIG. 6 illustrates side to side and front to back rotation according to this invention. The method includes steps of: providing an exercise apparatus that provides resistance during an exercise using dynamic therapeutic movement for chest, back, abdominal and leg musculature to strengthen muscles of the axial skeleton and lower extremities of a performing user; and providing adjustable resistance in two directions and adjustable assisted stretching in two directions.

Figure 7:
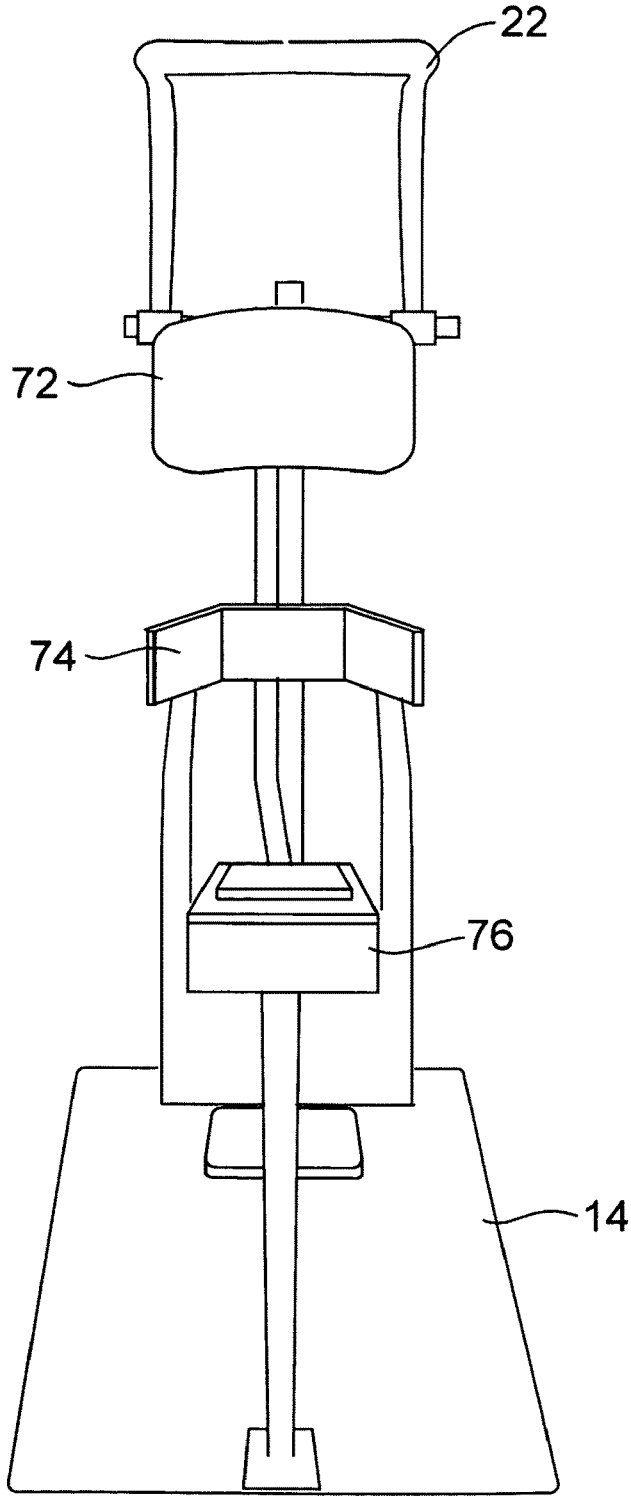
FIG. 7 is a front view showing the preferred embodiments of back supports and a real time display unit.

FIG. 7 is a front view showing the embodiments including back supports and a real time display unit. FIG. 7 shows shoulder securement 22, upper back support 72, lower back support 74, real time display unit 76 and support base 14. Display unit 76 preferably is positioned where the user may view the display. Display unit 76 is connected to controller 140 and computer 142 through conventional circuitry, not shown.

Figure 8:
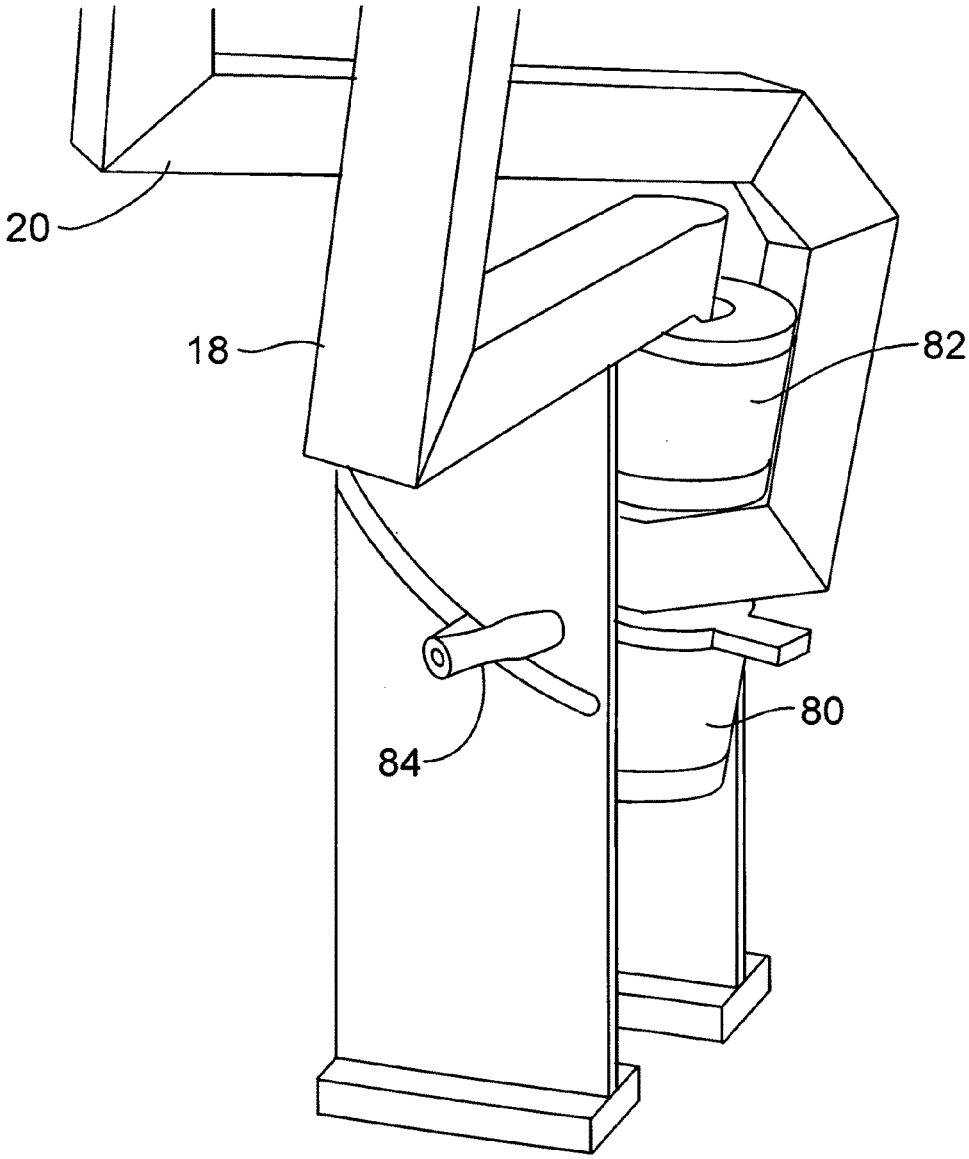
FIG. 8 is a sectional view showing the embodiments of magnetic brakes and an adjustable torso angle control.

FIG. 8 is a sectional view showing the embodiments of magnetic brakes and an adjustable torso angle control. FIG. 8 shows upper back arm 18 and lower back arm 20 connected to magnetic brakes 80 and 82. Magnetic brakes 80 and 82 replaces the disc or resistance brakes shown in FIG. 4. Member 16 supports and houses magnetic brakes 80 and 82. Member 16 also supports and houses control 84 which provides an adjustable torso angle to apparatus 10. Adjustable torso angle 84 comprises a lever, slot and rod for controlling torso angle.

Figure 9:
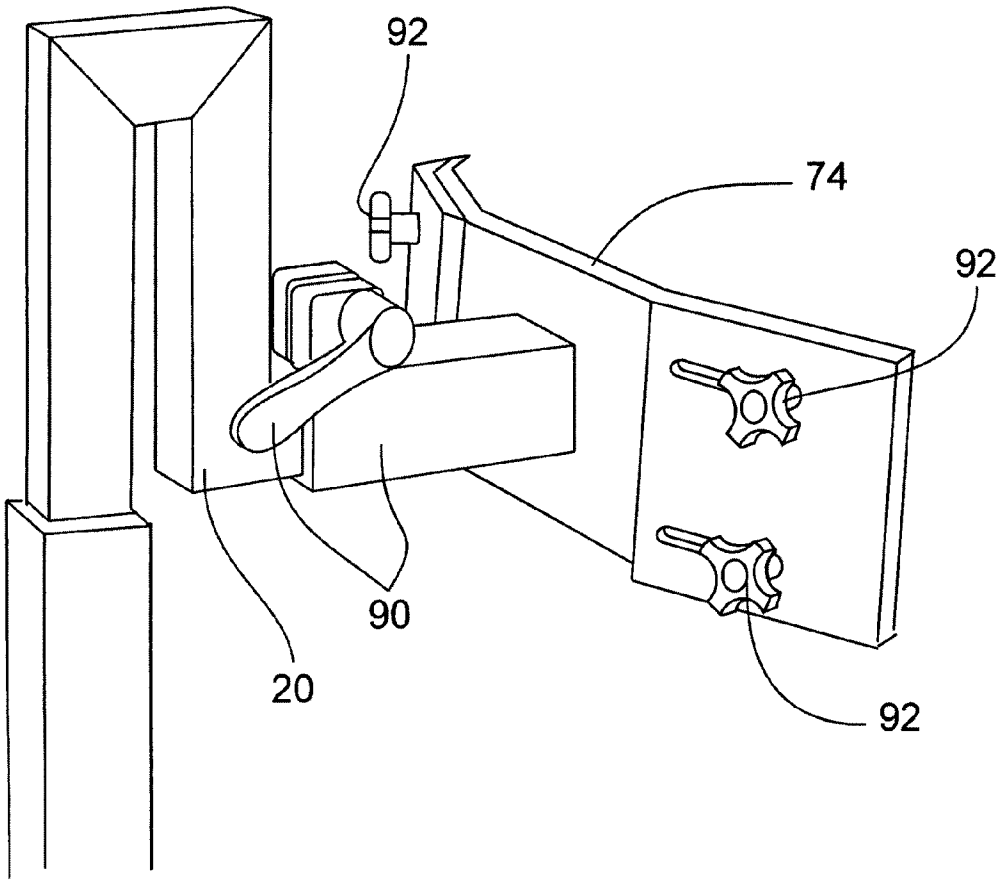
FIG. 9 is a sectional view showing the preferred embodiment of a control for the adjustable lower back support.

FIG. 9 is a sectional view showing an embodiment of a control for the adjustable lower back support. FIG. 9 shows adjustable lower back control 90 connected and positioned between lower back arm 20 and lower back support 74. Controls 92 provide adjustments for the hip size of the user.

Figure 10:
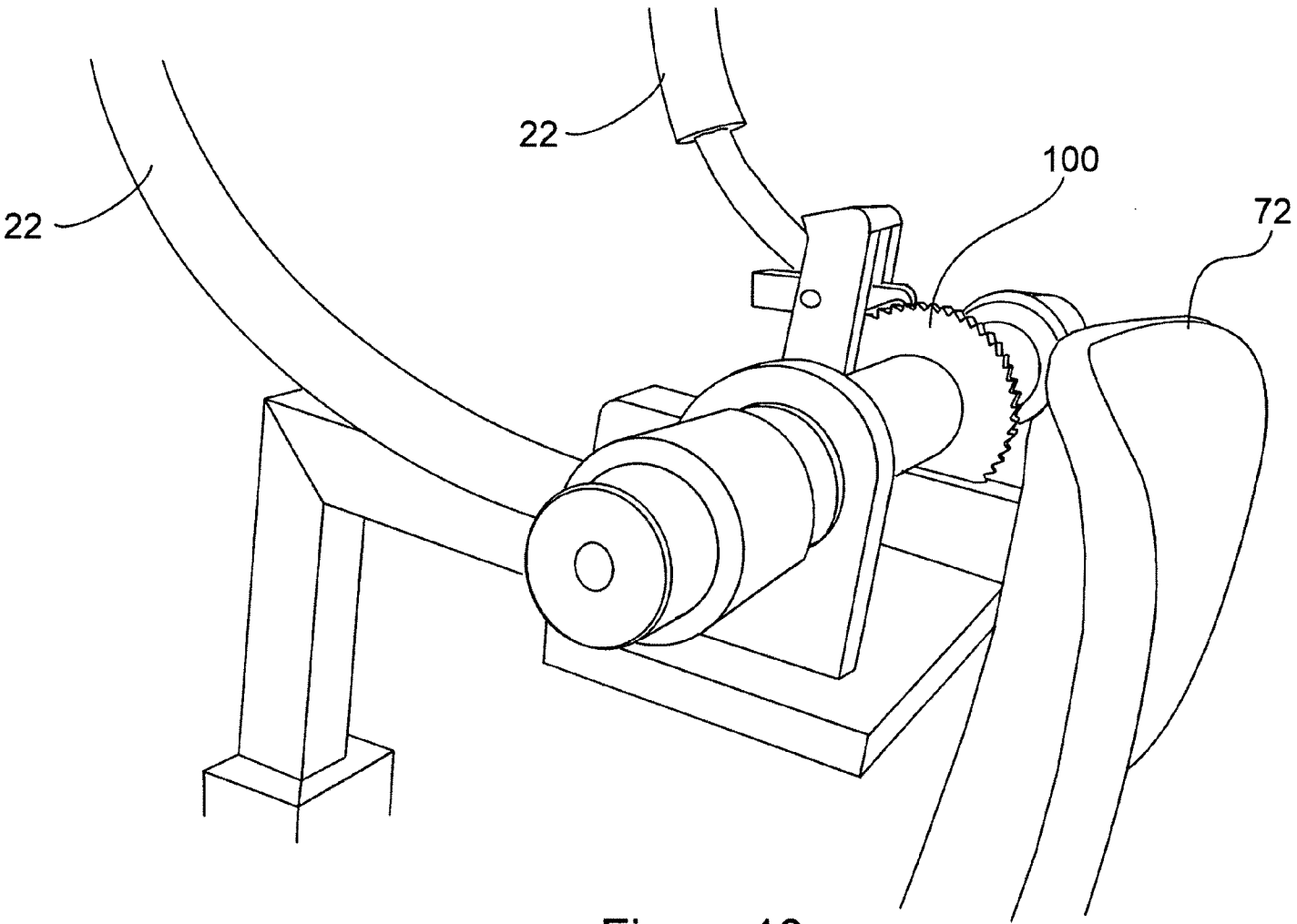
FIG. 10 is a sectional view showing the preferred embodiment of a ratchet for the shoulder securement.

FIG. 10 is a section view showing an embodiment of a ratchet for the shoulder harness. FIG. 10 shows ratchet 100 for shoulder harness 22 and upper back support 72.

Figure 11:
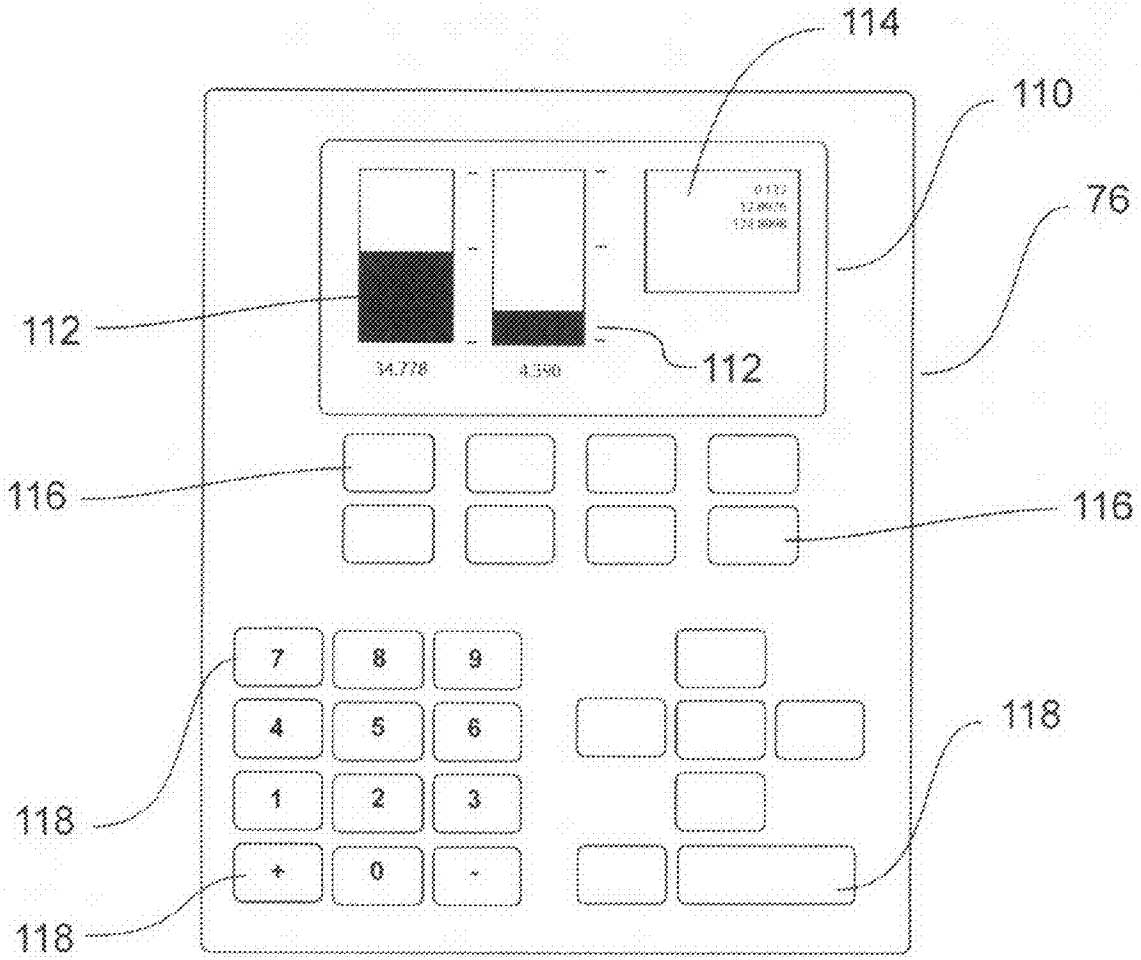
FIG. 11 is a sectional view showing the preferred embodiment of a real time position display.

FIG. 11 is a section view showing an embodiment of real time position display unit 76. Display unit 76 includes run screen 110, current status screen 112, cycle in use screen 114, soft key functions 116 and conventional key pad 118.

Figure 12:
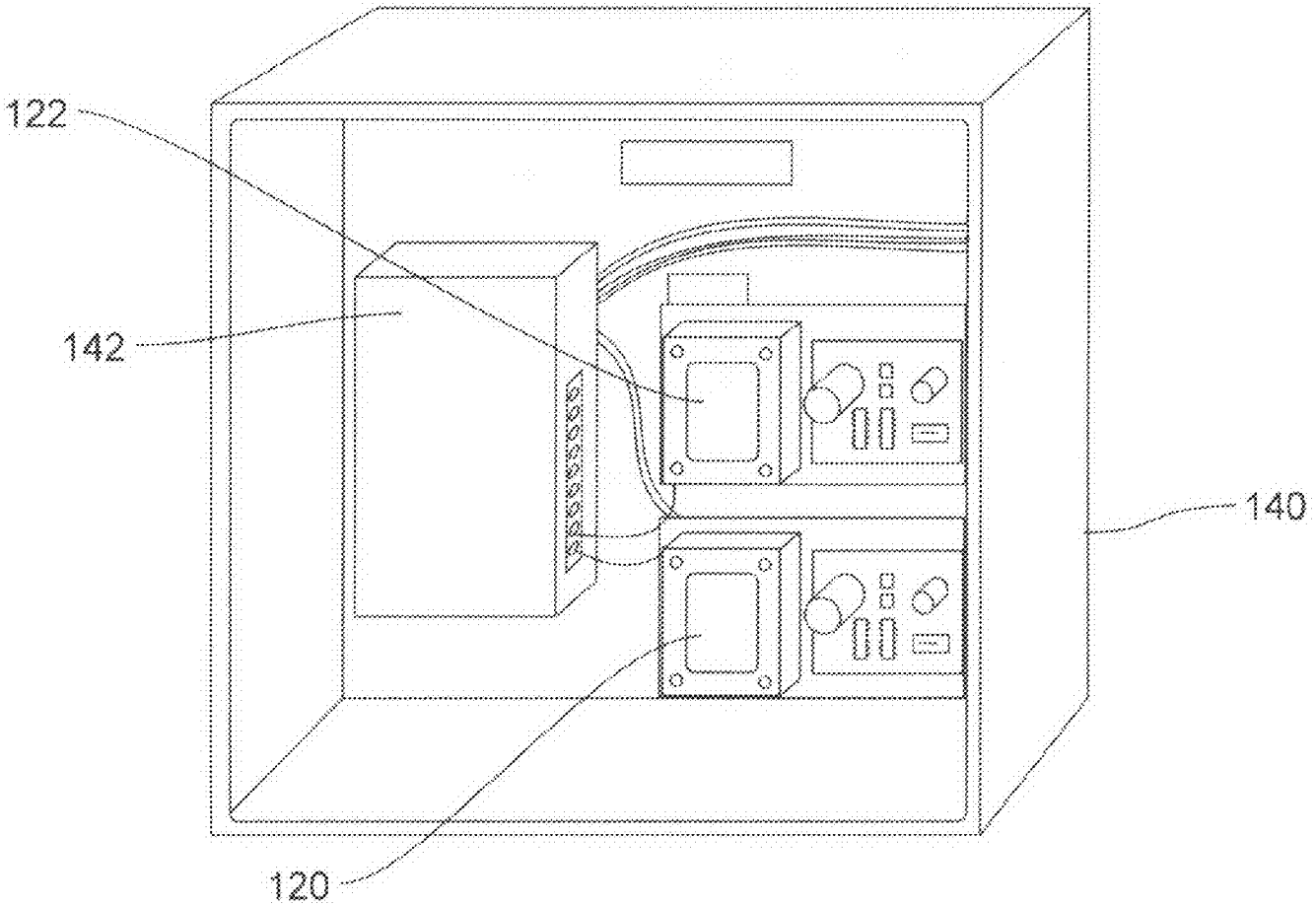
FIG. 12 is a sectional view showing the preferred embodiment for the controls for the magnetic brakes.

FIG. 12 is a sectional view showing an embodiment of magnetic brake controls. FIG. 12 shows control unit 140 including magnetic brake controls 120 and 122. Controls 120 and 122 are connected to control unit 140, computer 142 and magnetic brakes 80 and 82 through conventional circuitry, not shown.

Figure 13:
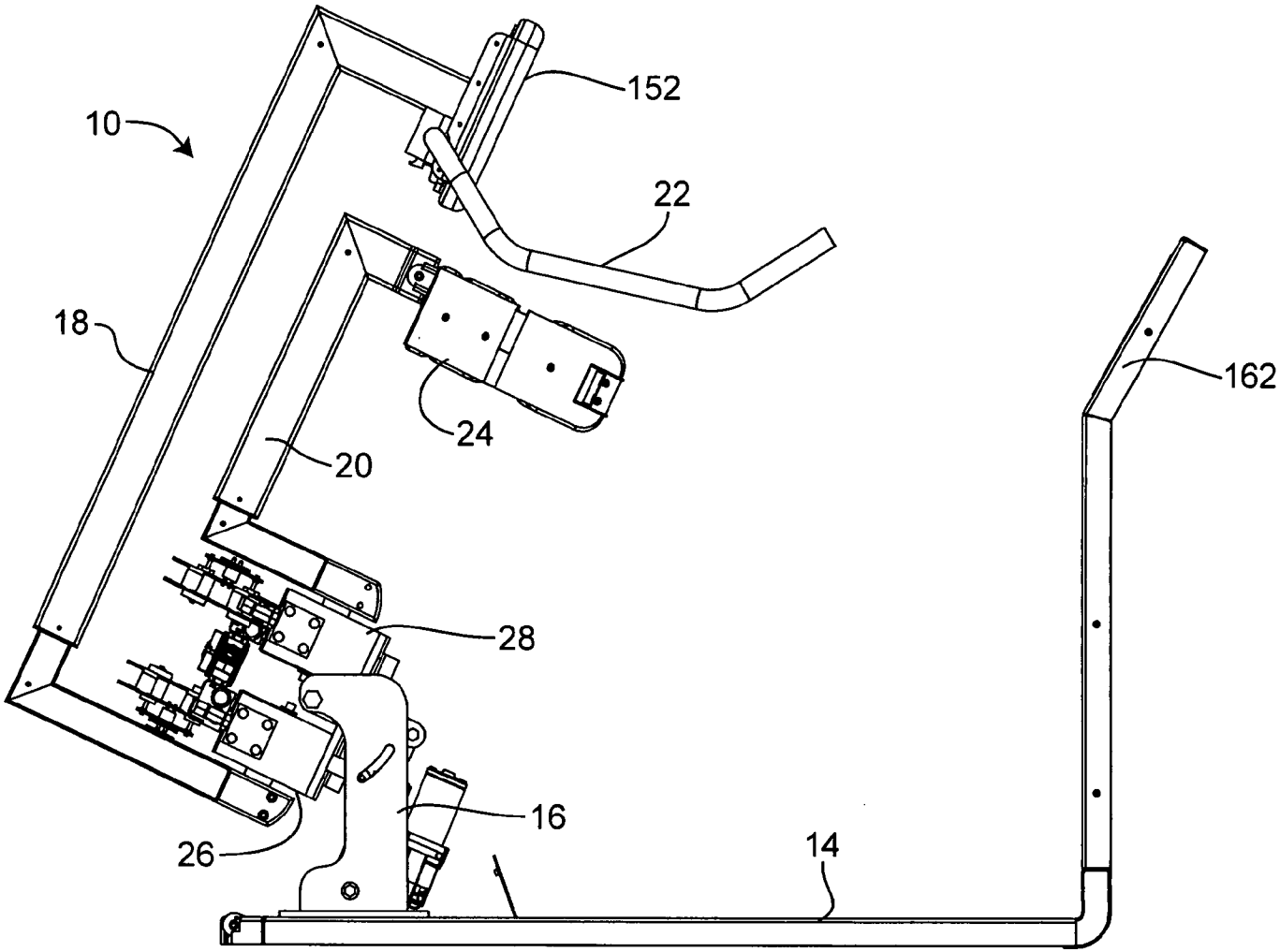
FIG. 13 is a side view illustrating a preferred embodiment of the core muscle strengthening device of this invention.

FIG. 13 is a side view illustrating a preferred embodiment of the core muscle strengthening device of this invention. FIG. 13 shows apparatus 10 that provides resistance using dynamic movement for chest, back, abdominal and leg musculature to strengthen muscles of the axial skeleton and lower extremities of a performing user. Apparatus 10 comprises support base 14, member 16 mounted to the support base, variable resistance, torso pivotally mounted axial shaft 18 coupled to pivotally mounted member 16, shoulder securement 22 connected to torso axial shaft 18, hip securement 24 connected to pelvis axial shaft 20, torso independent torque resistor 26 connected to torso axial shaft 18, and pelvis, independent torque resistor 26 connected to pelvis axial shaft 20. the angle of inclination (posture) is adjustable along the sagital axis.

Figure 14:
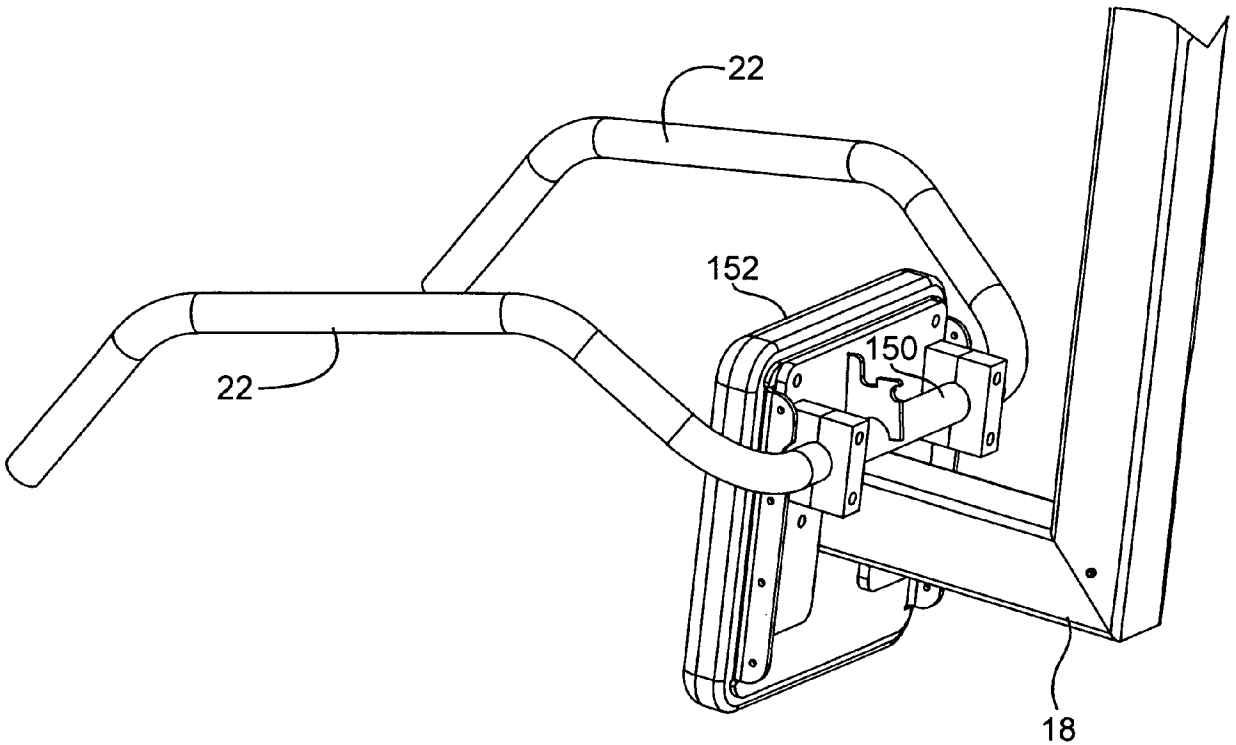
FIG. 14 is a view showing the resistance means that provide the resistance to shoulder rotation movement.

FIG. 14 is a view showing the resistance means that provide the resistance to shoulder rotation movement. FIG. 14 shows resistance actuator 150 attached to shoulder securements 22.

Figure 15:
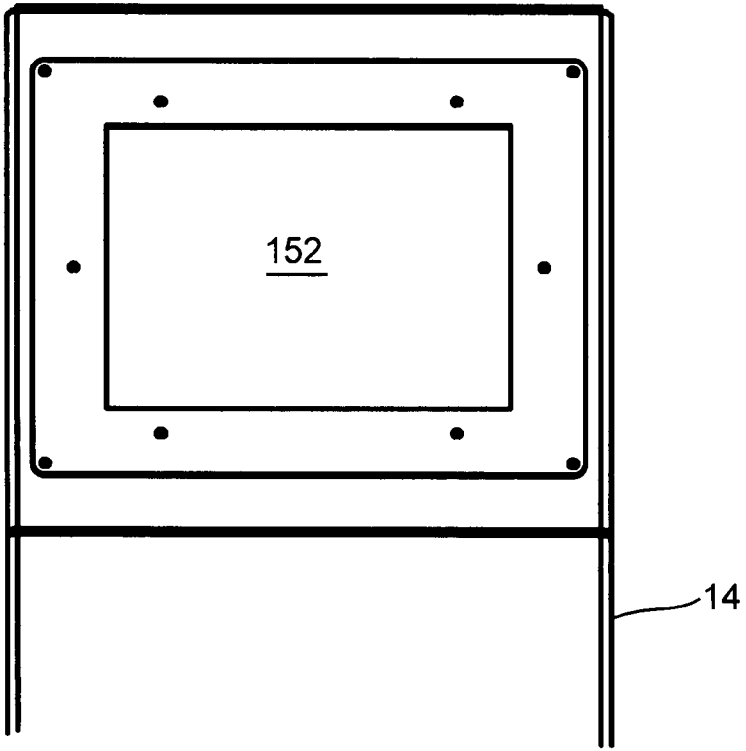
FIG. 15 is a top view showing the support base of the device of FIG. 13.

FIG. 15 is a top view showing the support base of the device of FIG. 13. FIG. 15 shows housing 152.

Figure 16:
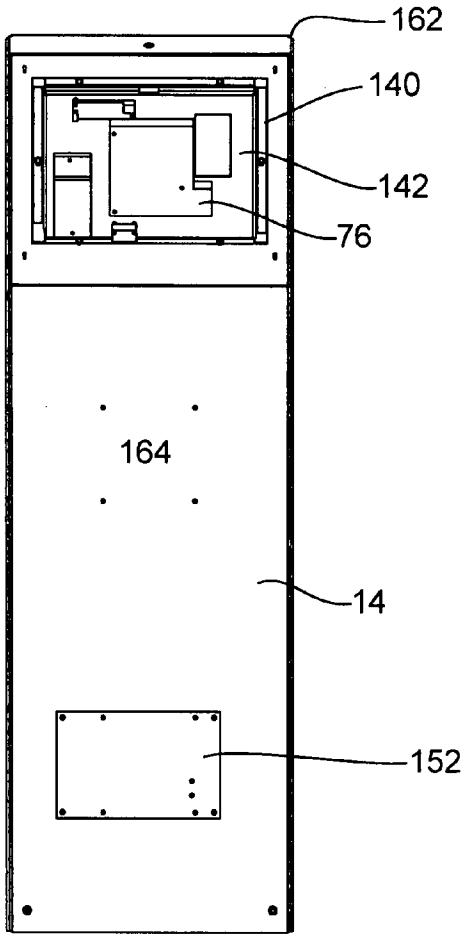
FIG. 16 is a top view showing the support base and the controller of the device of FIG. 13.

FIG. 16 is a top view showing the support base and the controller of the device of FIG. 13. FIG. 16 shows housing 162 supporting display unit 76, controller 140 and computer 142. Display unit 76 is connected to controller 140, computer 142 and device 10 through conventional circuitry, not shown. A performing user typically stands on pad 164.

Figure 17:
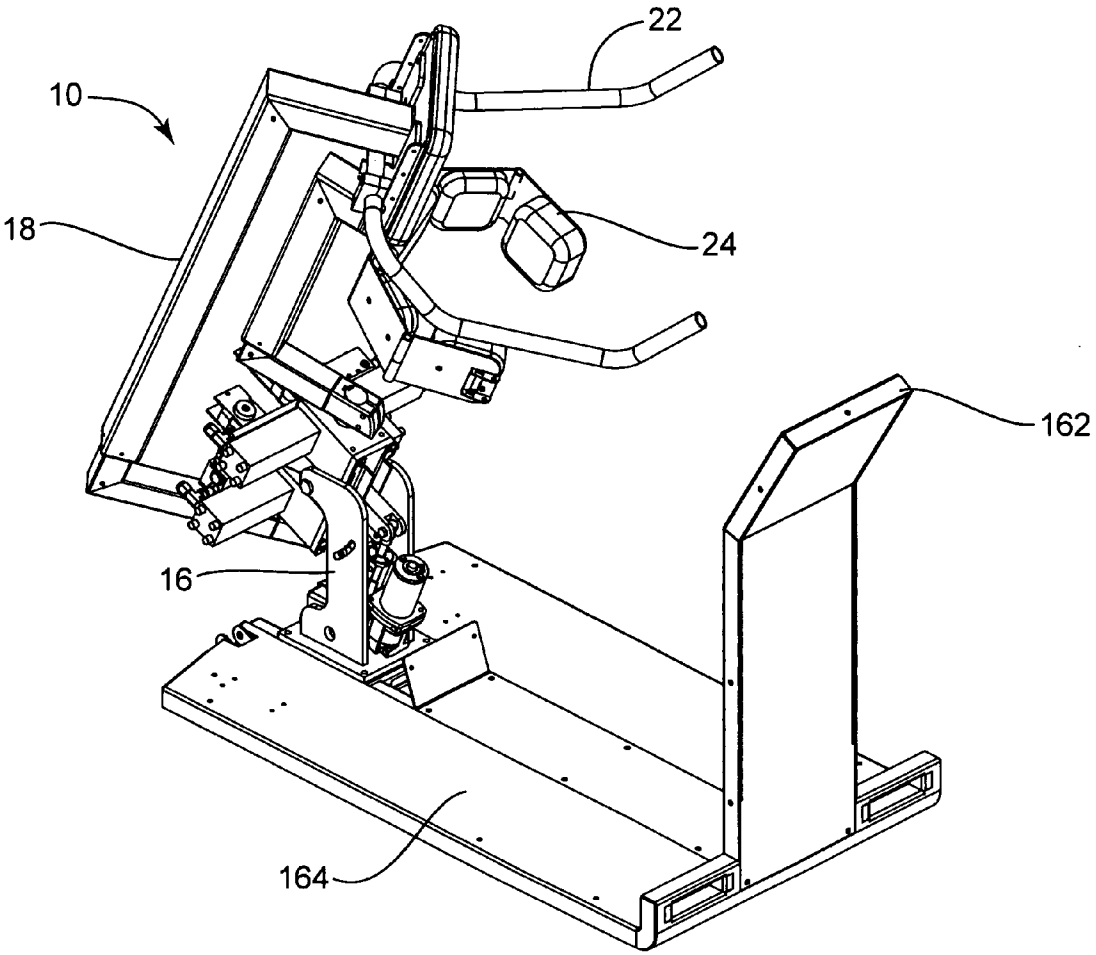
FIG. 17 is perspective view of the device of FIG. 13.

FIG. 17 is perspective view of the device of FIG. 13. FIG. 17 shows pad 164 in greater detail.

Figure 18:
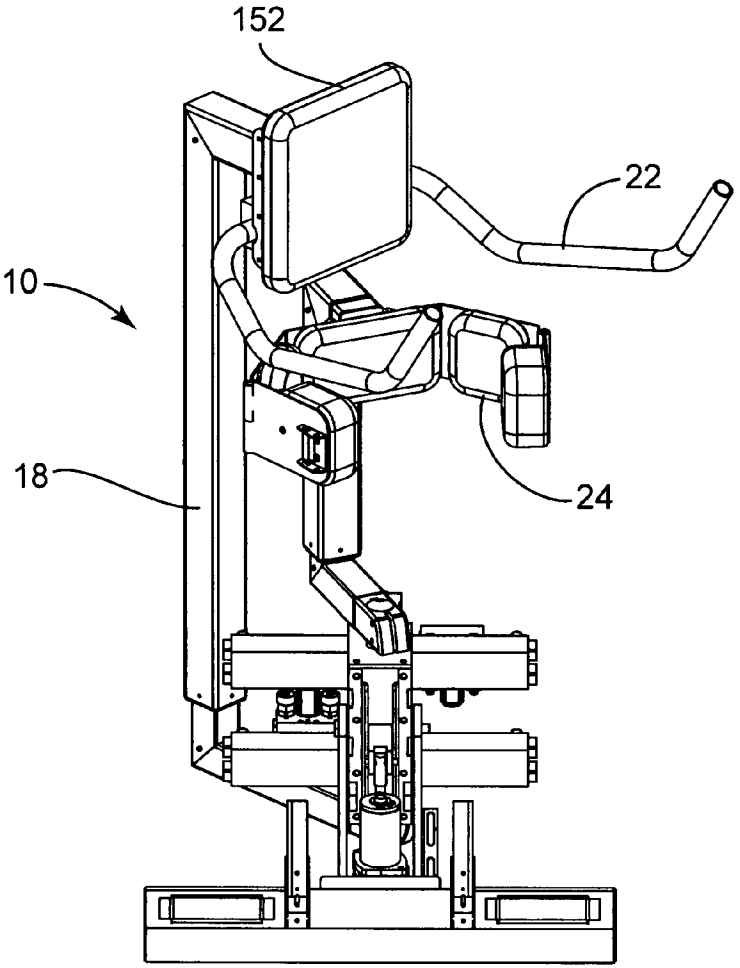
FIG. 18 is a side, perspective view of the device of FIG. 13 turned to the left.

FIG. 18 is a side, perspective view of the device of FIG. 13 turned to the left. FIG. 18 shows the pivotal movement of device 10 in greater detail. This movement provides resistance and assistance during core muscle training using dynamic therapeutic movement for chest, back, abdominal and leg musculature to strengthen and condition muscles of the axial skeleton and lower extremities of a performing user.

Figure 19:
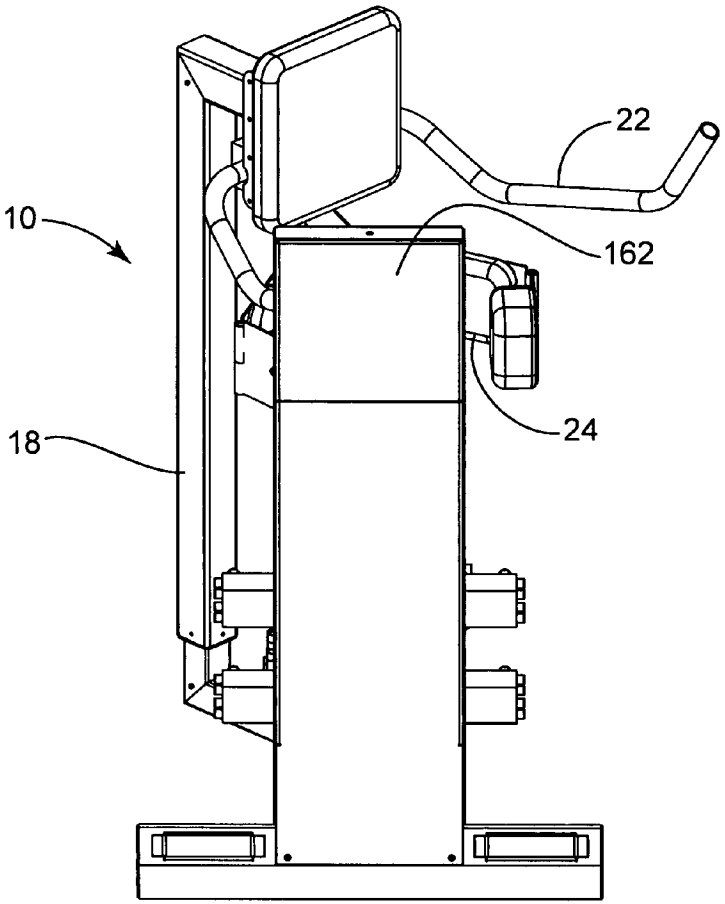
FIG. 19 is a front, perspective view of the device of FIG. 13 turned to the left.

FIG. 19 is a front, perspective view of the device of FIG. 13 turned to the left. FIG. 19 especially shows the range of pivotal movement of device 10 in providing adjustable resistance in two directions and adjustable assisted stretching in two directions.

Figure 20:
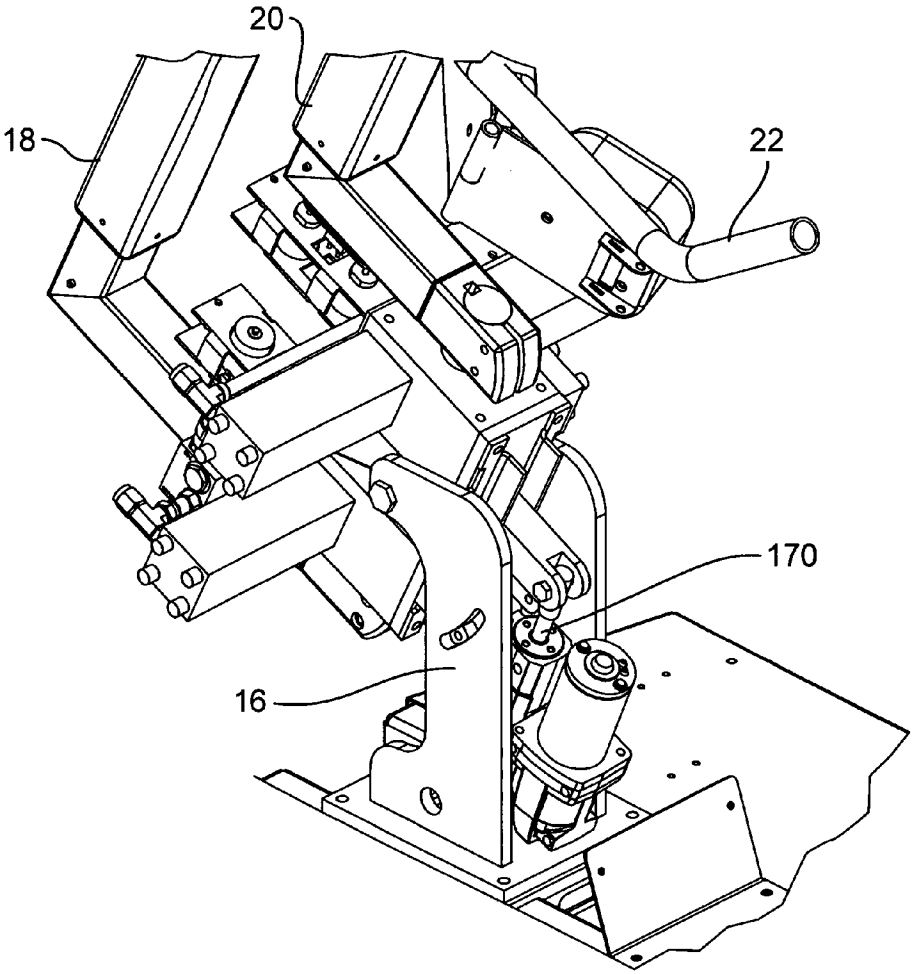
FIG. 20 is a sectional view showing the hydraulic brakes of the device of this invention.

FIG. 20 is a sectional view showing the hydraulic actuator of the device of this invention. FIG. 20 shows upper back arm 18 and lower back arm 20 connected to hydraulic actuator 170.

Figure 21:
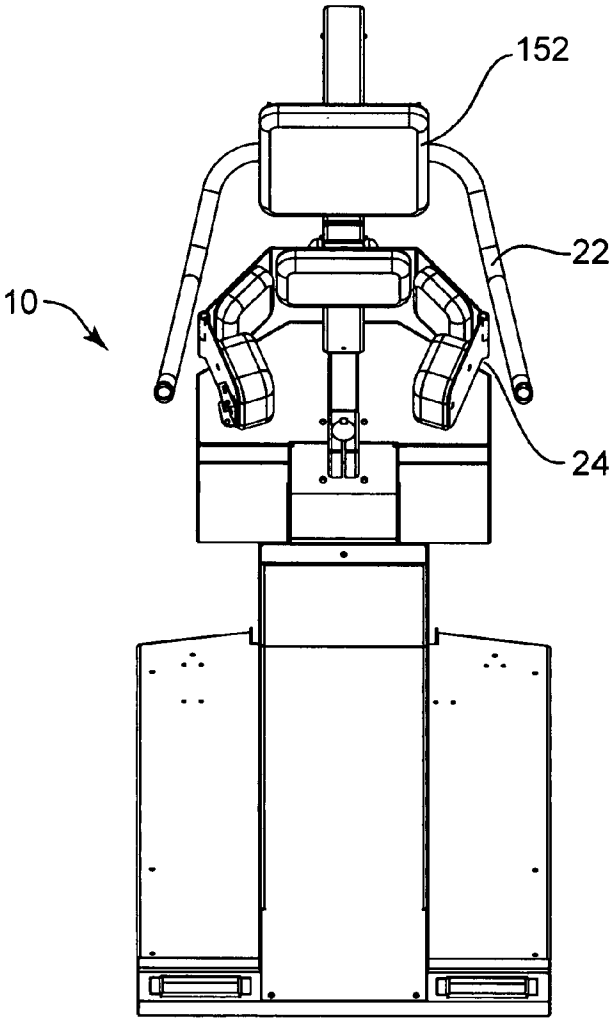
FIG. 21 is a front view of the device of this invention.

FIG. 21 is a front view of the device of this invention.

Figure 22:
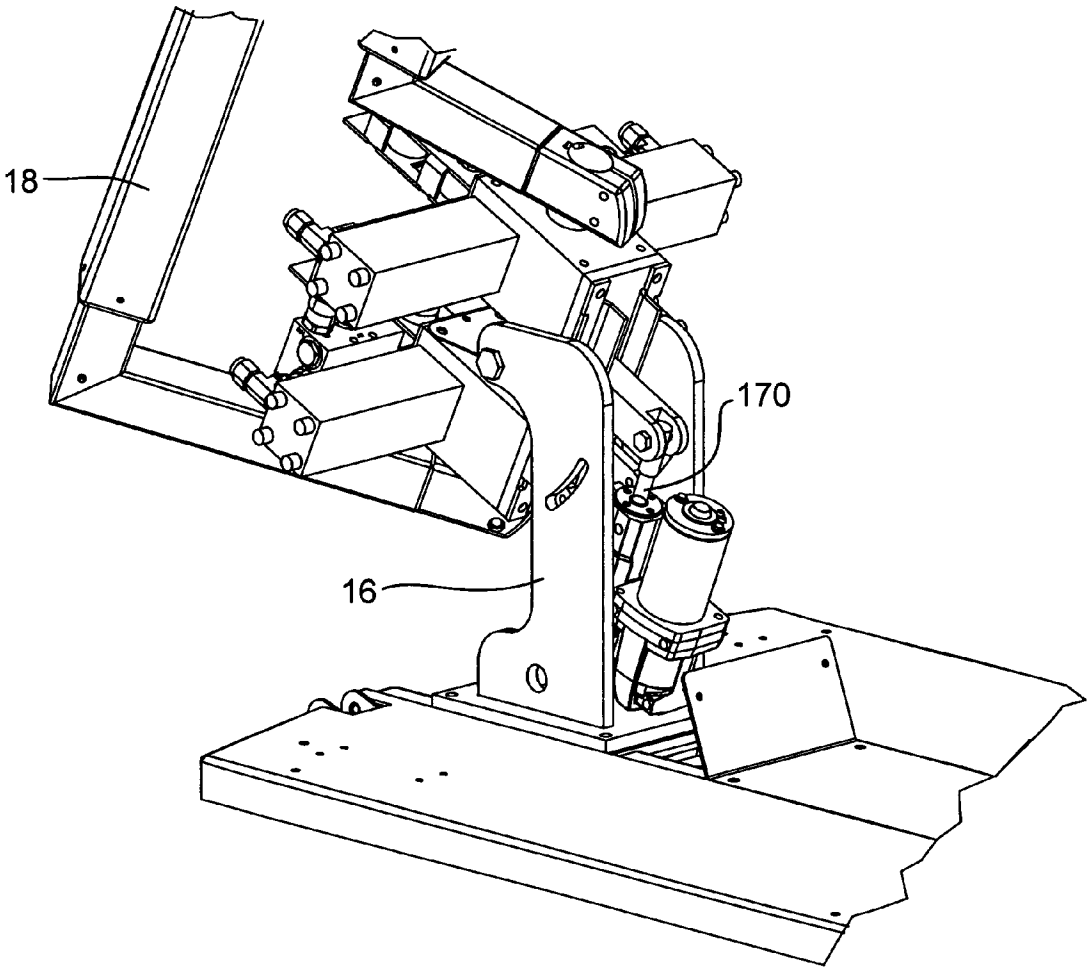
FIG. 22 is another sectional view showing the hydraulic brakes of the device of this invention.

FIG. 22 is another sectional view showing the hydraulic actuator of the device of this invention. Hydraulic actuator 170 is shown in greater detail.

Figure 23:
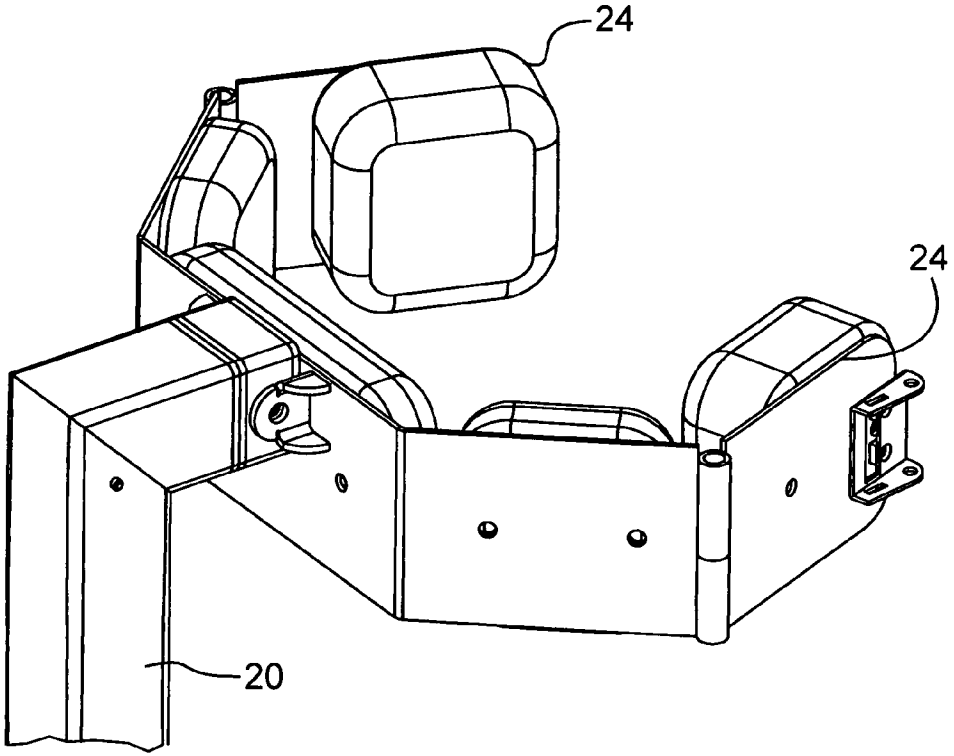
FIG. 23 is a sectional view showing the hip securement of the device of this invention.

FIG. 23 is a sectional view showing the hip securement of the device of this invention. Hip securement 24 is shown in greater detail.

In one embodiment, we employ a computer chip that tracks all aspects of performance over time. In this embodiment, a means measures at least one or all aspects of performance and converts the performance into an electrical signal representative of the performance being monitored. A programmed microprocessor including the computer chip is configured to identify the signal representative of the performance being monitored. The programmed microprocessor also is configured to identify and store the parameter (performance) being monitored. This enhanced version allows the professional to track their students. It also is used for the physical therapist and chiropractor to monitor a patient.

In another embodiment, shoulder securement 22 is not a true harness connected to a user's shoulders by a means such as a strap or belt. Preferably, shoulder harness 22 has a distal end with handles attached thereto. The user grasps the handles during use of apparatus 10.

The term "securement" used in this invention may vary widely. Often, harness, interface, engagement, belt, strap, tackle and the like may be used.

One preferred method of physical therapy comprises the steps of: providing an apparatus (10) that provides resistance and assistance during core muscle training using dynamic therapeutic movement for chest, back, abdominal and leg musculature to strengthen and condition muscles of the axial skeleton and lower extremities of a performing user; diagnosing and assessing a user's range of motion, strength, endurance and balance of the pelvis and trunk; demonstrating correct movement and balance; and training that user to improve range of motion, strength, endurance and balance of the pelvis and trunk; providing neuromuscular training; moving the user's body parts against selected forces; and applying the selected forces by one or more resistances to the user's body parts to programmed forces facilitating movement of the user's body parts.

One preferred embodiment is a therapist evaluation of a user using standard tests to determine deficiencies in movement; activating the user's body to provide resistance directed at core muscles of the body to reduce neuromotor and abnormal muscle tone secondary to patterns that develop because of compensatory activity that takes place to overused muscle activity.

Another preferred embodiment is a method for isometric exercise that allows muscle activation without movement: providing an apparatus (10) that provides resistance and assistance during therapy for chest, back, abdominal and leg musculature to strengthen and condition muscles of the axial skeleton and lower extremities of a performing user; locating a user in a posture within the apparatus (10) that simulates an isometric stance wherein the posture is such that a movement occurs is transverse plane along the vertical axis of rotation and passes through the user's spine; providing a torso, independent torque resistor (26) connected to the user that provides variable resistance; providing a pelvis, independent torque resistor (28) connected to the user that provides variable resistance; measuring at least one or all aspects of performance of the user; converting the measured performance into an electrical signal representative of the measured performance; providing a programmed microcompressor (140) including a micro chip configured to identify the signal representative of the performance; and configuring the programmed microcompressor (140) to identify and store the parameter (performance) being monitored.

Still another preferred embodiment is a method for physical therapy comprising the steps of: providing an apparatus (10) configured to provide resistance and assistance during therapy, and configured to provide natural resistance to force and maximize user comfort. Often, physical therapy may be considered non-invasive.

In still another embodiment, base 14 includes sensors which provide signals to the programmed microprocessor. These, for example, would help a PGA Professional, to monitor a student's weight shift during a golf swing. Knowing if a right handed golfer's weight is on the inside of the right foot at the top of the back swing would be a valuable teaching tool. Monitoring a weight shift to the outside of the left foot at the completion of the follow through would be equally valuable.

The programmed microprocessor also may be configured widely. The configuration may include a database with activity data, institutional research, user surveys; building normative data via institutional research; conducting professional/user surveys; electronics, internet; Balance Plates and the like.

In yet another embodiment, the physical therapy is configured to provide natural resistance to force and maximize user comfort.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A system for core muscle strengthening and flexibility comprising:

a means that provides resistance and assistance during core muscle training using dynamic therapeutic movement for chest, back, abdominal and leg musculature to strengthen and condition muscles of the axial skeleton and lower extremities of a performing user, comprising:

a support base (14);

a member (16) mounted to the support base (14);

an axial assembly (17) pivotally mounted to the member (16);

a variable resistance, pivotally mounted, torso engaging arm (18) coupled to the pivotally mounted axle assembly (19);

a variable resistance, pivotally mounted, torso engaging arm (20) coupled to the pivotally mounted axle assembly (19);

a shoulder engaging harness (22) connected to the torso engaging arm (18);

a hip engaging harness (24) connected to the pelvis engaging arm (20);

an independent torque resistor (26) connected to the torso engaging arm (18);

an independent torque resistor (28) connected to the pelvis engaging arm (20);

a means (142) for measuring at least one or all aspects of performance of the performing user and converting the measured performance into an electrical signal representative of the measured performance; and a programmable microprocessor (140) including a micro chip configured to identify the signal representative of the performance; wherein the programmed microprocessor (140) also is configured to identify and store the parameter (performance) being monitored.

2. A system according to claim 1 further comprising a real time display unit (76) connected to controller (140) and computer (142).

3. A system according to claim 1 further comprising magnetic brakes (80) and (82) connected to torso engaging arm (18) and torso engaging arm (20) to provide variable resistance to arm (18) and arm (20).

4. A system according to claim 1 further comprising adjustable lower back control 90 connected and positioned between arm 20 and lower back support 74.

5. A system according to claim 1 further comprising resistance actuator (150) attached to shoulder harness (22).

* * * * *